US012140149B1

(12) United States Patent
Chen

(10) Patent No.: US 12,140,149 B1
(45) Date of Patent: Nov. 12, 2024

(54) OUTDOOR CEILING FAN

(71) Applicant: AIR COOL INDUSTRIAL CO., LTD., Taichung (TW)

(72) Inventor: Ken-Tuan Chen, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 18/386,610

(22) Filed: Nov. 3, 2023

(51) Int. Cl.
*F04D 25/08* (2006.01)
*F04D 29/40* (2006.01)
*F04D 29/60* (2006.01)

(52) U.S. Cl.
CPC ..... *F04D 25/088* (2013.01); *F04D 29/403* (2013.01); *F04D 29/601* (2013.01)

(58) Field of Classification Search
CPC ..... F04D 25/088
See application file for complete search history.

(56) References Cited

U.S. PATENT DOCUMENTS 4,714,230 A * 12/1987 Huang ..... F16M 11/08 248/343
5,899,663 A * 5/1999 Feder ..... F04D 29/34 416/5
6,116,559 A * 9/2000 Lackey ..... F04D 29/601 416/246
6,139,279 A * 10/2000 Pearce ..... F04D 25/088 416/244 R
2017/0204869 A1* 7/2017 Horng ..... F04D 29/601
2020/0141047 A1* 5/2020 Chang ..... D06F 58/00

FOREIGN PATENT DOCUMENTS

CN 114151369 * 12/2023

* cited by examiner

*Primary Examiner* — Brian O Peters
(74) *Attorney, Agent, or Firm* — Ying-Ting Chen

(57) ABSTRACT

An outdoor ceiling fan includes a ceiling fan body, a lower tube fixedly connected to the ceiling fan body, and an upper tube insertedly connected to the lower tube. The upper tube is telescopic and adjustable relative to the lower tube through an adjustment seat. A hanger is fixedly connected to the upper tube. The hanger covers the top of the upper tube. A waterproof gasket is provided between the housing of the ceiling fan body and the lower tube. A waterproof ferrule is provided among the upper tube, the adjustment seat and the lower tube. The outdoor ceiling fan has the effects of blowing air over a large area, being waterproof, and having a retractable down rod, lighting function and good safety.

10 Claims, 7 Drawing Sheets

OUTDOOR CEILING FAN

FIELD OF THE INVENTION

The present invention relates to a ceiling fan, and more particularly to an outdoor ceiling fan.

BACKGROUND OF THE INVENTION

When it is required to use a fan outdoors, most users choose to use stand fans. Stand fans cannot achieve the effect of blowing air over a large area. When a stand fan is used outdoors, because the manually-operated rotating shaft of the stand fan is in the vertical direction, there is a gap in the vertical direction between the rotating shaft of the stand fan and the housing of the stand fan, so the stand fan does not have a waterproof effect. Accordingly, the inventor of the present invention has devoted himself based on his many years of practical experiences to solve these problems.

SUMMARY OF THE INVENTION

The primary object of the present invention is to provide an outdoor ceiling fan, which has the effects of blowing air over a large area, being waterproof, and having a retractable down rod, lighting function and good safety.

In order to achieve the foregoing object, the present invention provides an outdoor ceiling fan, comprising a ceiling fan body, a lower tube, an upper tube, an adjustment seat and a hanger. The ceiling fan body includes a waterproof housing and a motor. The waterproof housing has an accommodation space therein. The motor is disposed in the accommodation space of the waterproof housing. The waterproof housing includes at least one housing. The housing of the waterproof housing surrounds an outer periphery of the accommodation space. The waterproof housing has an upper opening and a lower opening. The motor is connected to a fan blade unit via the lower opening. The lower tube is a hollow tube. The lower tube is inserted in the upper opening. A waterproof gasket is provided between the upper opening and the lower tube. A lower end of the lower tube is in the accommodation space and fixedly connected to the ceiling fan body. A top of the lower tube has a top edge extending inwardly. A lower tube opening is formed inside the top edge. The upper tube is a hollow tube. The upper tube is inserted in the lower tube opening. A bottom of the upper tube has a bottom edge extending outwardly. The bottom edge is in the lower tube. The bottom edge of the upper tube has a diameter greater than that of the lower tube opening so that the upper tube and the bottom edge are movable in the lower tube. An upper end of the upper tube is laterally perforated with two upper tube apertures. The adjustment seat is sleeved on an outside of the top of the lower tube and an outside of the upper tube. The adjustment seat is fixedly connected to the lower tube. The adjustment seat includes a fastening member corresponding to the upper tube for selectively fastening the upper tube. The adjustment seat further includes a waterproof ferrule on the outside of the upper tube. The waterproof ferrule is located between the adjustment seat and the lower tube opening. The hanger has a hook and a hook opening below the hook. The hanger further has a switch corresponding to the hook opening for opening or closing the hook opening. A bottom of the hook extends downward to form an annular wall. The hanger and the annular wall form a receiving groove. A bottom of the receiving groove forms a receiving groove opening for receiving a top of the upper tube. Two sides of the annular wall are perforated with two hanger apertures corresponding to the upper tube apertures. The hanger includes a fixing member corresponding to the hanger apertures and the upper tube apertures for fixing the hanger and the upper tube. The fixing member has two holding portions on an outside of the annular wall. Two waterproof washers are provided between the holding portions and the hanger apertures. The waterproof washers are located on respective outer peripheries of the hanger apertures. The holding portions hold the waterproof washers on the annular wall.

In the outdoor ceiling fan provided by the present invention, the upper tube is telescopic and adjustable relative to the lower tube through the adjustment seat. The bottom edge of the upper tube and the top edge of the lower tube prevent the ceiling fan body from falling. The receiving groove of the hanger and the waterproof washers prevent rainwater from entering the upper tube. The waterproof ferrule prevents rainwater from entering the lower tube from the upper tube. The waterproof gasket prevents rainwater from entering the waterproof housing from the lower tube, thereby preventing rainwater from entering the waterproof housing.

DETAILED DESCRIPTION OF THE PREFERRED EMBODIMENTS

Figure 1:
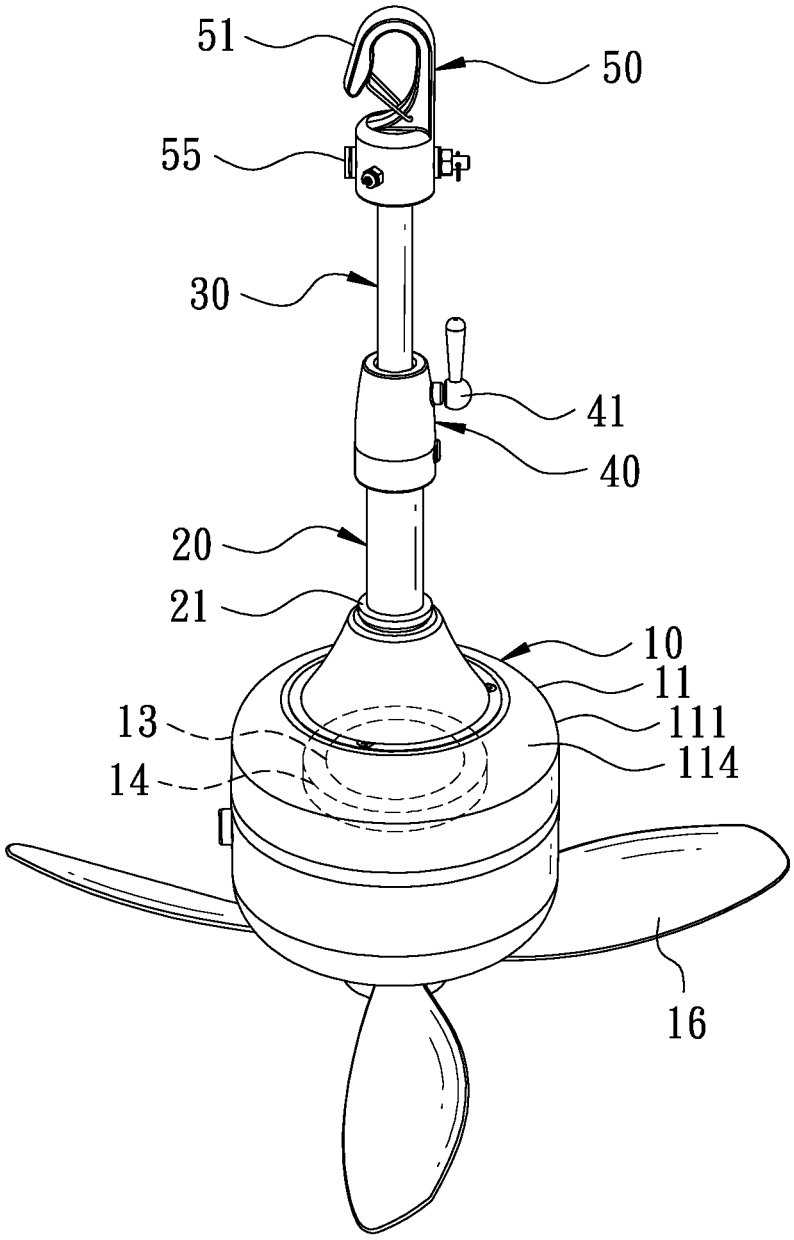
FIG. 1 is a perspective view of the present invention.
Figure 2:
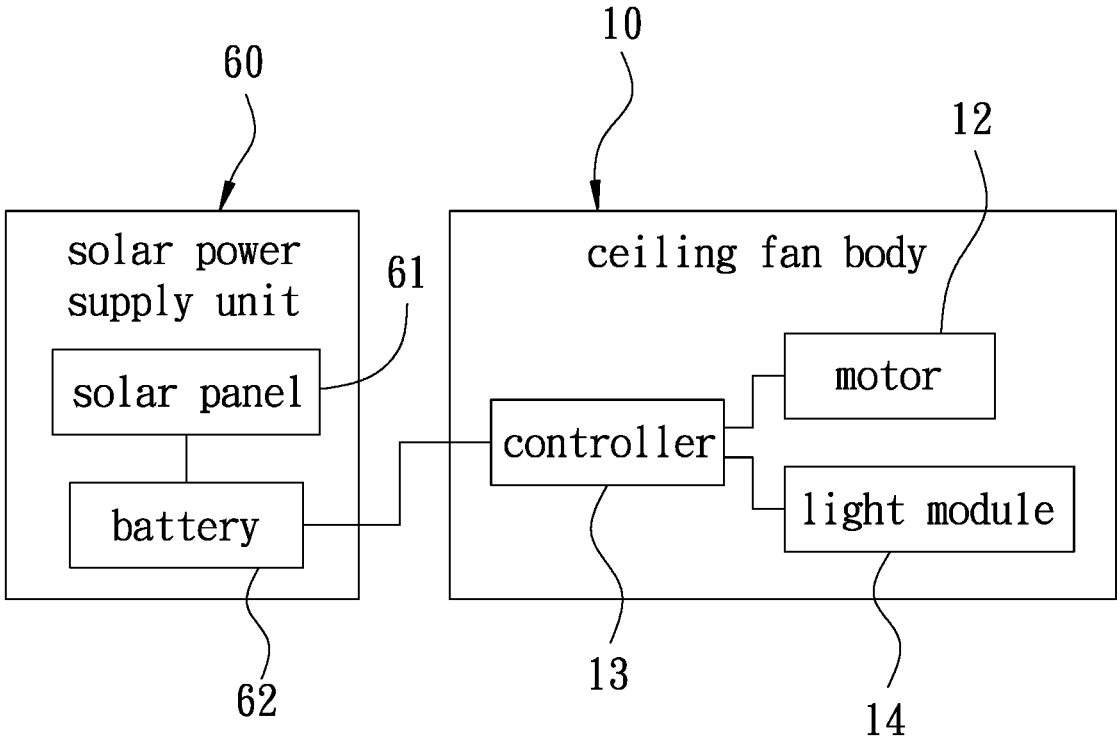
FIG. 2 is a block diagram in accordance with an embodiment of the present invention.
Figure 3:
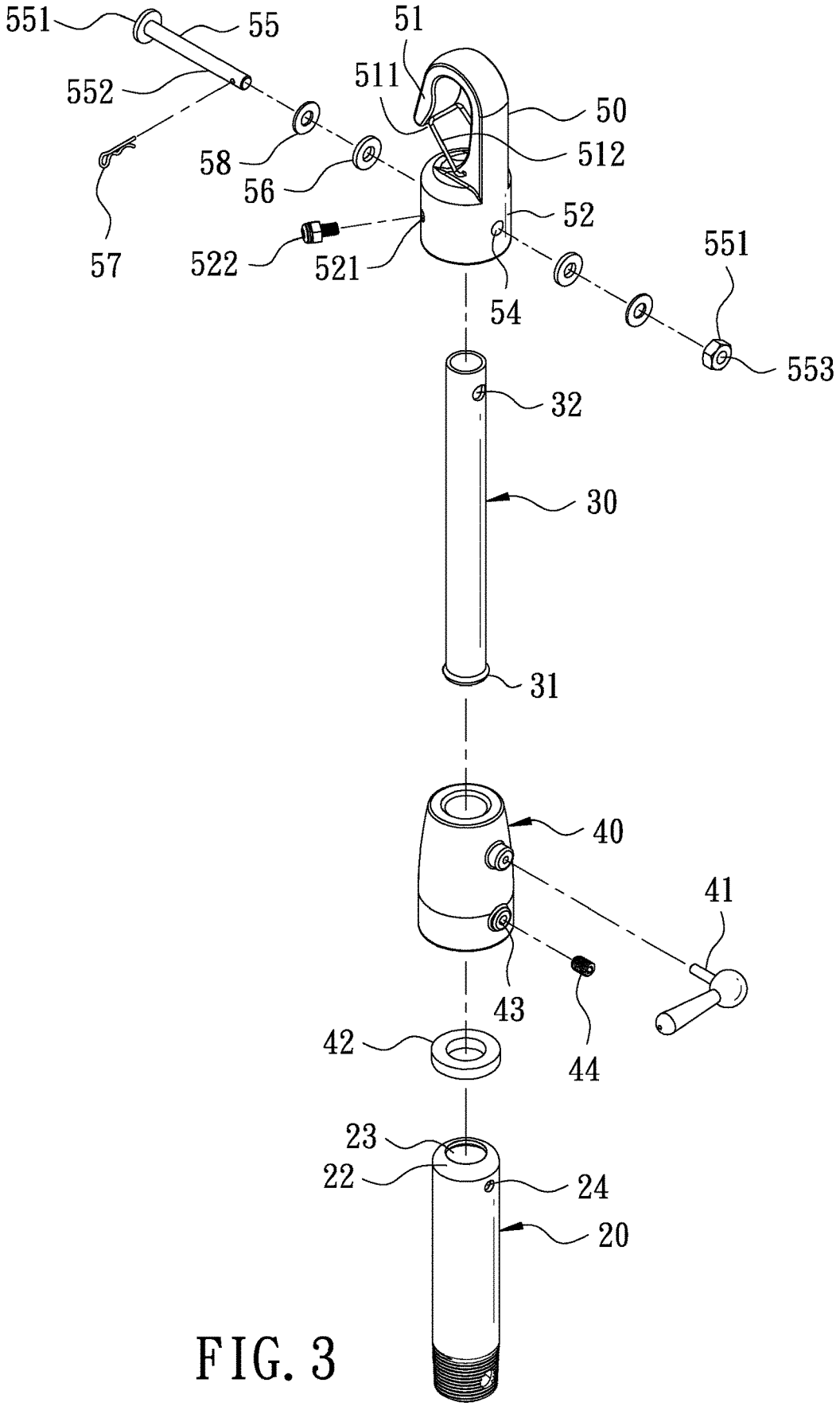
FIG. 3 is a partial exploded view in accordance with the embodiment of the present invention, illustrating the hanger, the upper tube, the lower tube and the adjustment seat.
Figure 4:
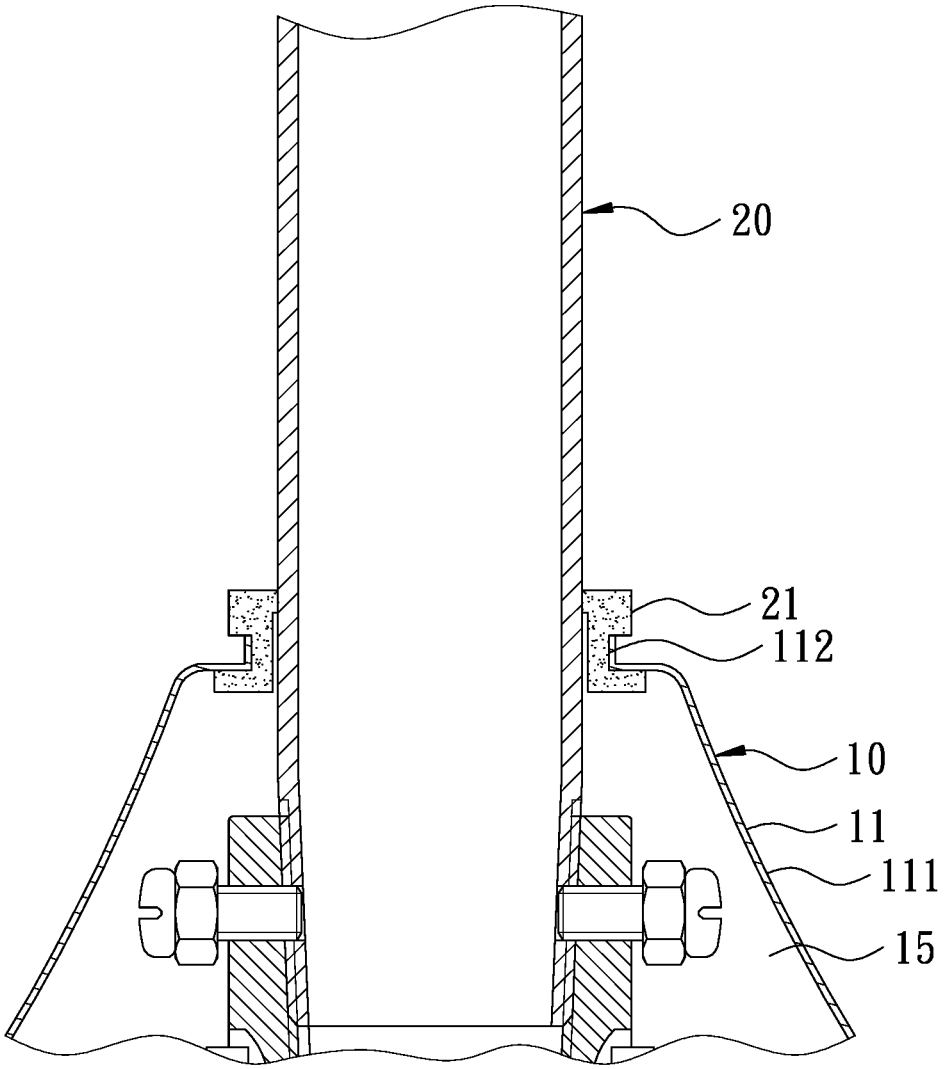
FIG. 4 is a partial cross-sectional view in accordance with the embodiment of the present invention, illustrating the ceiling fan body, the lower tube and the waterproof gasket.
Figure 5:
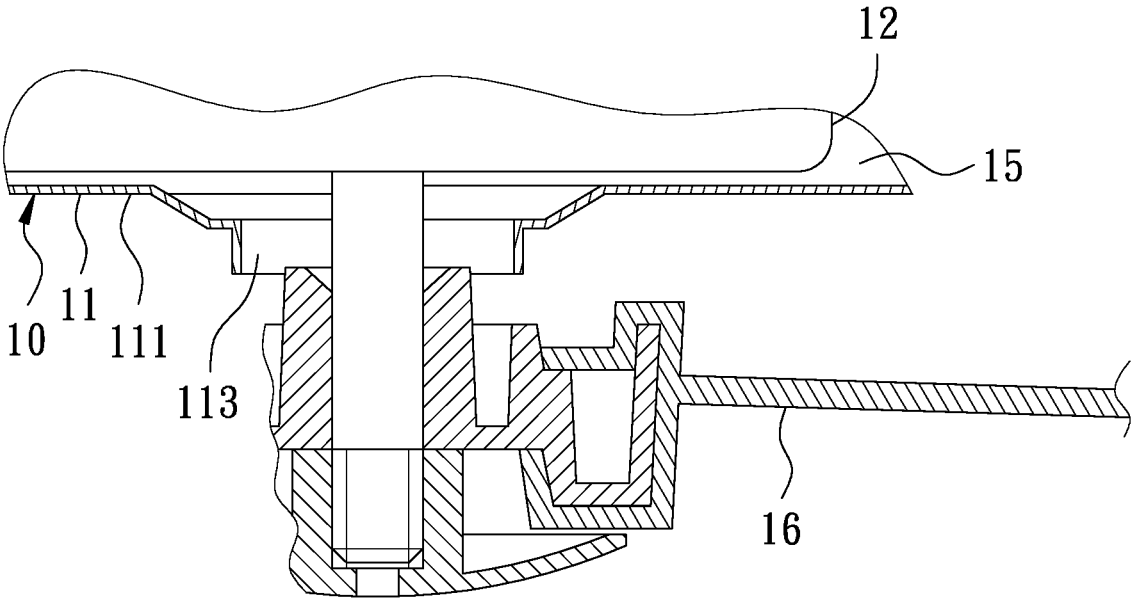
FIG. 5 is a partial cross-sectional view in accordance with the embodiment of the present invention, illustrating the ceiling fan body, the motor and the fan blade unit.

Embodiments of the present invention will now be described, by way of example only, with reference to the accompanying drawings.

Referring to FIG. 1 through FIG. 7, the present invention discloses an outdoor ceiling fan, comprising a ceiling fan body 10, a lower tube 20, an upper tube 30, an adjustment seat 40, a hanger 50, and a solar power supply unit 60.

The ceiling fan body 10 includes a waterproof housing 11, a motor 12, a controller 13, and a light module 14. The waterproof housing 11 has an accommodation space 15 therein. The motor 12, the controller 13 and the light module 14 are disposed in the accommodation space 15 of the waterproof housing 11. The waterproof housing 11 includes at least one housing 111. The housing 111 of the waterproof housing 11 surrounds the outer periphery of the accommodation space 15. The waterproof housing 11 has an upper opening 112 and a lower opening 113. The motor 12 is connected to a fan blade unit 16 via the lower opening 113. The at least one housing 111 further has a transparent housing 114. The light module 14 is disposed in the transparent housing 114. The controller 13 is electrically connected to the motor 12 and the light module 14, so that the light module 14 emits light passing through the transparent housing 114 for illuminating the outer periphery of the ceiling fan body 10.

The lower tube 20 is a hollow tube. The lower tube 20 is inserted in the upper opening 112. A waterproof gasket 21 is provided between the upper opening 112 and the lower tube 20. The waterproof gasket 21 is made of rubber and is used for filling the gap, so as to prevent rainwater from entering the waterproof housing 11. The lower end of the lower tube 20 is in the accommodation space 15 and fixedly connected to the ceiling fan body 10. The top of the lower tube 20 has a top edge 22 extending inwardly. A lower tube opening 23 is formed inside the top edge 22. The lower tube 20 further has a lower tube screw hole 24.

Figure 6:
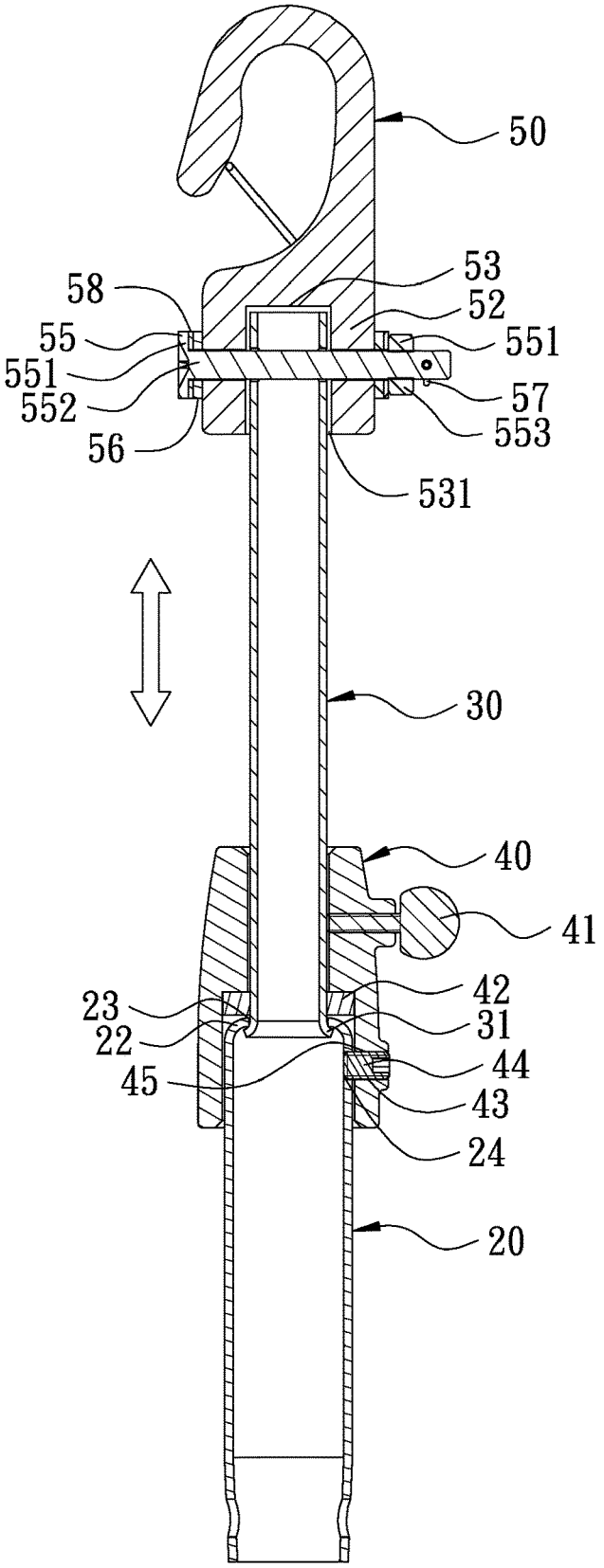
FIG. 6 is a schematic view showing the use of the embodiment of the present invention when in use, wherein the upper tube is extended relative to the lower tube.
Figure 7:
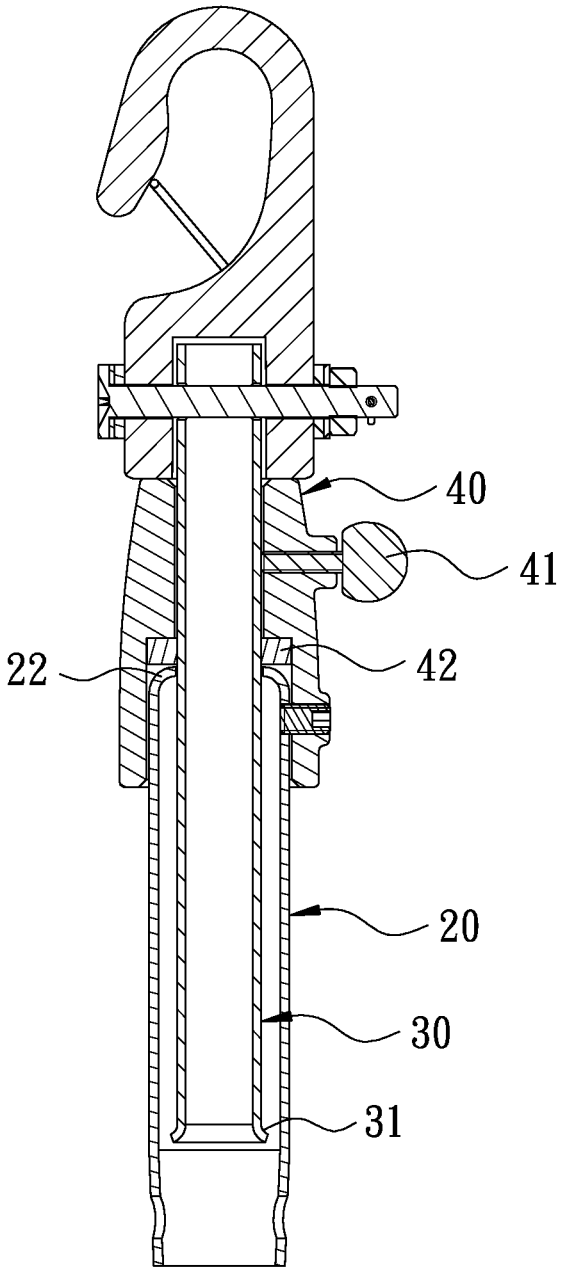
FIG. 7 is a schematic view showing the use of the embodiment of the present invention when in use, wherein the upper tube is retracted relative to the lower tube.

The upper tube 30 is a hollow tube. The upper tube 30 is inserted in the lower tube opening 23. The bottom of the upper tube 30 has a bottom edge 32 extending outwardly. The bottom edge 31 is in the lower tube 20. The diameter of the bottom edge 31 of the upper tube 30 is greater than the diameter of the lower tube opening 23 to prevent the upper tube 30 from being separated from the lower tube 20, thereby preventing the ceiling fan body 10 from falling. The upper tube 30 and the bottom edge 31 are movable in the lower tube 20. As shown in FIG. 6 and FIG. 7, the upper end of the upper tube 30 is laterally perforated with two upper tube apertures 32. The upper tube 30 is telescopic relative to the lower tube 20.

The adjustment seat 40 is sleeved on the outside of the top of the lower tube 20 and the outside of the upper tube 30. The adjustment seat 40 is fixedly connected to the lower tube 20. The adjustment seat 40 includes a fastening member 41 corresponding to the upper tube 30, such that the upper tube 30 is selectively fastened for adjusting the relative position of the upper tube 30 and the lower tube 20. The adjustment seat 40 further includes a waterproof ferrule 42 on the outside of the upper tube 30. The waterproof ferrule 42 is located between the adjustment seat 40 and the lower tube opening 23. The waterproof ferrule 42 is made of rubber and is used for filling the gap to prevent rainwater from entering the lower tube 20 from the gap between the upper tube 30 and the adjustment seat 40, thereby achieving a retractable length and waterproof effect. The adjustment seat 40 further has an adjustment seat screw hole 43 corresponding to the lower tube screw hole 24 for the adjustment seat 40 and the lower tube 20 to be fixedly connected through a screw 44 and a waterproof adhesive 45 applied to the outer periphery thereof.

The hanger 50 has a hook 51 and a hook opening 511 below the hook 51. The hanger 50 further has a switch 512 corresponding to the hook opening 511 for opening or closing the hook opening 511, so that the user can hang the ceiling fan outdoors. The bottom of the hook 51 extends downward to form an annular wall 52. The hanger 50 and the annular wall 52 form a receiving groove 53. The bottom of the receiving groove 53 forms a receiving groove opening 531 for receiving the top of the upper tube 30, so as to prevent rainwater from entering the upper tube 30 from the top of the upper tube 30. Two sides of the annular wall 52 are perforated with two hanger apertures 54 corresponding to the upper tube apertures 32. The hanger 50 includes a fixing member 55 corresponding to the hanger apertures 54 and the upper tube apertures 32 for fixing the hanger 50 and the upper tube 30. The fixing member 55 has two holding portions 551 on the outside of the annular wall 52. Two waterproof washers 56 are provided between the holding portions 551 and the hanger apertures 54. The waterproof washers 56 are made of rubber. The waterproof washers 56 are located on the outer peripheries of the hanger apertures 54, respectively. The holding portions 551 hold the waterproof washers 56 on the annular wall 52 to prevent rainwater infiltration. The fixing member 55 has a pin 552 and a nut 553. The head of the pin 552 is defined as one of the holding portions 551, and the nut 553 is defined as the other one of the holding portions 551. The body of the pin 552 is inserted through the hanger apertures 54 and the upper tube apertures 32. The nut 553 is screwed to the thread of the pin 552 on the outside of the hanger 50. A restricting member 57 is insertedly connected to the pin 552. The restricting member 57 is located at the outer side of the nut 553 for restricting the nut 553 and preventing the nut 553 from loosening. Flat washers 58 are provided between the holding portion 551 of the pin 552 and the waterproof washers 56 to protect the fixing member 55 and reduce vibration. The annular wall 52 further has a plurality of holding member apertures 521 corresponding to the upper tube 30 for a plurality of holding members 522 to pass through the holding member apertures 521 to hold the upper tube 30, so as to prevent the upper tube 30 from shaking in the receiving groove 53.

The solar power supply unit 60 is electrically connected to the ceiling fan body 10. The solar power supply unit 60 includes a solar panel 61 and a battery 62. The solar panel 61 is electrically connected to the battery 62. The battery 62 is electrically connected to the controller 13 of the ceiling fan body 10 for supplying power to the ceiling fan body 10.

Therefore, in the outdoor ceiling fan provided by the present invention, the adjustment seat 40 can adjust the telescopic length of the upper tube 30 relative to the lower tube 20. The ceiling fan body 10 can be prevented from falling through the bottom edge 31 of the upper tube 30 and the top edge 22 of the lower tube 20. The receiving groove 53 of the hanger 50 and the waterproof washers 56 can prevent rainwater from entering the upper tube 30. The waterproof ferrule 42 can prevent rainwater from entering the lower tube 20 from the upper tube 30. The waterproof gasket 21 can prevent rainwater from entering the waterproof housing 11 from the lower tube 20, thereby preventing rainwater from entering the waterproof housing 11.

What is claimed is:

1. An outdoor ceiling fan, comprising:

a ceiling fan body, including a waterproof housing and a motor, the waterproof housing having an accommodation space therein, the motor being disposed in the accommodation space of the waterproof housing, the waterproof housing including at least one housing, the housing of the waterproof housing surrounding an outer periphery of the accommodation space, the waterproof housing having an upper opening and a lower opening, the motor being connected to a fan blade unit via the lower opening;

a lower tube, the lower tube being a hollow tube, the lower tube being inserted in the upper opening, a waterproof gasket being provided between the upper opening and the lower tube, a lower end of the lower tube being in the accommodation space and fixedly connected to the ceiling fan body, a top of the lower tube having a top edge extending inwardly, a lower tube opening being formed inside the top edge;

an upper tube, the upper tube being a hollow tube, the upper tube being inserted in the lower tube opening, a bottom of the upper tube having a bottom edge extending outwardly, the bottom edge being in the lower tube, the bottom edge of the upper tube having a diameter greater than that of the lower tube opening so that the upper tube and the bottom edge are movable in the lower tube, an upper end of the upper tube being laterally perforated with two upper tube apertures;

an adjustment seat, sleeved on an outside of the top of the lower tube and an outside of the upper tube, the adjustment seat being fixedly connected to the lower tube, the adjustment seat including a fastening member corresponding to the upper tube for selectively fastening the upper tube, the adjustment seat further including a waterproof ferrule on the outside of the upper tube, the waterproof ferrule being located between the adjustment seat and the lower tube opening;

a hanger, having a hook and a hook opening below the hook, the hanger further having a switch corresponding to the hook opening for opening or closing the hook opening, a bottom of the hook extending downward to form an annular wall, the hanger and the annular wall forming a receiving groove, a bottom of the receiving groove forming a receiving groove opening for receiving a top of the upper tube, two sides of the annular wall being perforated with two hanger apertures corresponding to the upper tube apertures, the hanger including a fixing member corresponding to the hanger apertures and the upper tube apertures for fixing the hanger and the upper tube, the fixing member having two holding portions on an outside of the annular wall, two waterproof washers being provided between the holding portions and the hanger apertures, the waterproof washers being located on respective outer peripheries of the hanger apertures, the holding portions holding the waterproof washers on the annular wall;

wherein the upper tube is telescopic and adjustable relative to the lower tube through the adjustment seat, the bottom edge of the upper tube and the top edge of the lower tube prevent the ceiling fan body from falling, the receiving groove of the hanger and the waterproof washers prevent rainwater from entering the upper tube, the waterproof ferrule prevents rainwater from entering the lower tube from the upper tube, the waterproof gasket prevents rainwater from entering the waterproof housing from the lower tube, thereby preventing rainwater from entering the waterproof housing.

2. The outdoor ceiling fan as claimed in claim 1, wherein the fixing member has a pin and a nut, a head of the pin is defined as one of the holding portions, the nut is defined as the other one of the holding portions, the pin is inserted through the hanger apertures and the upper tube apertures, and the nut is screwed to the pin on an outside of the hanger.

3. The outdoor ceiling fan as claimed in claim 2, wherein a restricting member is insertedly connected to the pin, and the restricting member is located at an outer side of the nut for restricting the nut.

4. The outdoor ceiling fan as claimed in claim 3, wherein flat washers are provided between the holding portion of the pin and the waterproof washers, respectively.

5. The outdoor ceiling fan as claimed in claim 4, wherein the annular wall further has a plurality of holding member apertures corresponding to the upper tube for a plurality of holding members to pass through the holding member apertures to hold the upper tube.

6. The outdoor ceiling fan as claimed in claim 5, wherein the waterproof gasket, the waterproof ferrule and the waterproof washers are made of rubber.

7. The outdoor ceiling fan as claimed in claim 6, wherein the lower tube further has a lower tube screw hole, the adjustment seat further has an adjustment seat screw hole corresponding to the lower tube screw hole for the adjustment seat and the lower tube to be fixedly connected through a screw and a waterproof adhesive.

8. The outdoor ceiling fan as claimed in claim 6, further comprising a solar power supply unit, wherein the solar power supply unit is electrically connected to the ceiling fan body, and the solar power supply unit includes a solar panel and a battery for supplying power to the ceiling fan body.

9. The outdoor ceiling fan as claimed in claim 8, wherein the ceiling fan body further includes a controller and a light module, the controller and the light module are disposed in the accommodation space of the waterproof housing, the at least one housing further has a transparent housing, the light module is disposed in the transparent housing, and the controller is electrically connected to the motor and the light module.

10. The outdoor ceiling fan as claimed in claim 1, further comprising a solar power supply unit, wherein the solar power supply unit is electrically connected to the ceiling fan body, the solar power supply unit includes a solar panel and a battery for supplying power to the ceiling fan body, the ceiling fan body further includes a controller and a light module, the controller and the light module are disposed in the accommodation space of the waterproof housing, the at least one housing further has a transparent housing, the light module is disposed in the transparent housing, and the controller is electrically connected to the motor and the light module.

* * * * *